US007845384B2

(12) United States Patent
Goodman et al.

(10) Patent No.: US 7,845,384 B2
(45) Date of Patent: Dec. 7, 2010

(54) PARTITION SYSTEMS AND METHODS OF OPERATING PARTITION SYSTEMS

(75) Inventors: E. Carl Goodman, Bountiful, UT (US); Ronald A. Smart, Sandy, UT (US); Craig Bell, South Jordan, UT (US)

(73) Assignee: Won-Door Corporation, Salt Lake City, UT (US)

( * ) Notice: Subject to any disclaimer, the term of this patent is extended or adjusted under 35 U.S.C. 154(b) by 372 days.

(21) Appl. No.: 11/840,095

(22) Filed: Aug. 16, 2007

(65) Prior Publication Data

US 2009/0044918 A1 Feb. 19, 2009

(51) Int. Cl.
*E06B 3/48* (2006.01)

(52) U.S. Cl. ..... 160/118; 160/199; 292/251.5

(58) Field of Classification Search ..... 160/199, 160/206, 118; 292/251.5, DIG. 15; 16/82; 24/303

See application file for complete search history.

(56) References Cited

U.S. PATENT DOCUMENTS

| | | | | |
|---|---|---|---|---|
| 2,471,634 | A * | 5/1949 | Mark et al. | 49/395 |
| 2,519,435 | A * | 8/1950 | Byrd, Jr. | 292/251.5 |
| 2,565,891 | A * | 8/1951 | Sherman | 292/251.5 |
| 2,786,702 | A * | 3/1957 | Teetor | 292/251.5 |
| 2,840,408 | A * | 6/1958 | Scott et al. | 292/251.5 |
| 3,431,002 | A | 3/1969 | Melgaard | |
| 3,468,576 | A * | 9/1969 | Beyer et al. | 292/251.5 |
| 3,600,025 | A | 8/1971 | Brainard | |
| 3,790,197 | A * | 2/1974 | Parker | 292/251.5 |
| 4,099,755 | A | 7/1978 | Anderson | |
| 4,822,085 | A | 4/1989 | Guity-Mehr | |
| 4,991,887 | A | 2/1991 | Hahn | |
| 5,061,112 | A | 10/1991 | Monford, Jr. | |
| 5,611,120 | A | 3/1997 | Riceman et al. | |
| 5,782,512 | A | 7/1998 | Cargnoni | |
| 6,253,826 | B1 | 7/2001 | Witter et al. | |
| 6,296,038 | B1 * | 10/2001 | Chen | 160/199 |

(Continued)

FOREIGN PATENT DOCUMENTS

KR 10-2003-0040545 B1 11/2005

OTHER PUBLICATIONS

PCT International Search Report for Application No. PCT/US2008/073190, dated 23 Jun. 2009, 3 pages.

(Continued)

*Primary Examiner*—Blair M. Johnson
(74) *Attorney, Agent, or Firm*—TraskBritt

(57) ABSTRACT

A partition system is provided as well as an apparatus and method for securing movable partitions. In one embodiment, a movable partition, such as a folding door, includes a post member (e.g., a lead post) having a latching structure associated therewith. Another post member, such as associated with a wall or another movable partition, includes a latching structure configured to form a magnetic coupling with the first latching structure. One of the latching structures may be slidingly displaced relative to its associated post member so as to selectively bring the two latching members into or out of alignment with one another. When a magnetic coupling has been formed, relative displacement of the two latching structures results in the weakening, if not defeat, of the magnetic coupling so that the post members, and their associated partitions, may be displaced away from one another. Other latching structures are also disclosed.

18 Claims, 17 Drawing Sheets

U.S. PATENT DOCUMENTS

| | | | | |
|---|---|---|---|---|
| 6,976,715 | B2 | 12/2005 | Lyon | |
| 7,089,627 | B2 | 8/2006 | Seidler | |
| 7,583,500 | B2 * | 9/2009 | Ligtenberg et al. | 361/147 |
| 2006/0175842 | A1 | 8/2006 | Saitoh et al. | |
| 2007/0138806 | A1 * | 6/2007 | Ligtenberg et al. | 292/251.5 |
| 2008/0061565 | A1 * | 3/2008 | Lee et al. | 292/251.5 |
| 2009/0044918 | A1 * | 2/2009 | Goodman et al. | 160/202 |

OTHER PUBLICATIONS

Written Opinion of the International Searching Authority for Application No. PCT/US2008/073190, dated Jun. 23, 2009, 4 pages.

* cited by examiner

PARTITION SYSTEMS AND METHODS OF OPERATING PARTITION SYSTEMS

FIELD OF THE INVENTION

The present invention relates generally to movable partitions including so-called folding doors or partitions and, more particularly, to securing such folding doors or partitions relative to one another or relative to some other structure when, for example, the door or partition is in a deployed or closed condition.

BACKGROUND OF THE INVENTION

Movable partitions are utilized in numerous situations and environments for a variety of purposes. Such partitions may include for example, foldable or collapsible doors configured to close-off an opening in order to enclose a room or to subdivide a single large room into one or more smaller rooms. The subdivision of one or more larger areas may be desired, for example, to accommodate the simultaneous meeting of multiple groups. In such applications movable partitions are useful for providing privacy and noise reduction.

For example, referring to FIG. 1, a movable or folding partition system 100 including one or more accordion-type doors 102A and 102B may be used to subdivide a space into multiple, smaller spaces. The doors 102A and 102B shown include a plurality of panels 104 which are connected to one another with hinges 106 or other hinge-like structures. The hinged connection of the panels 104 allows the panels to fold and stack adjacent one another such that the doors 102A and 102B may be compactly stored in pockets 108 formed in the walls 110 of a building when the doors 102A and 102B are in a retracted or folded state. When the doors 102A and 102B are deployed to subdivide an area, the doors 102A and 102B may be displaced along a track 112 to provide the desired barrier.

As shown in FIGS. 1 and 2A, two doors 102A and 102B may be utilized wherein each extends from its associated pocket 108 to cooperatively mate with one another. Referring to FIG. 2A, a cross-sectional view is shown of two doors 102A and 102B (each being shown in a folded state and recessed in pockets 108) which may be referred to as a bi-part configuration. The first door 102A includes a male lead post 114 which is configured to cooperatively mate with the female lead post 116 of the second door 102B when each door is properly extended.

Alternatively, the partition system 100 may comprise a single door which mates with a stationary structure to form a barrier. As shown in FIG. 2B, a single door 102A may include a male lead post 114 which is configured to mate with a female door post 116' formed in a wall 110.

As can also be seen in FIG. 2B, an accordion-type door 102A may include a first accordion-style partition 118A and a second accordion-style partition 118B which is laterally spaced from, and substantially parallel with, the first partition 118A. Each of the two partitions 118A and 118B has a first end 120 structurally fixed to a floating jamb 122 which is movable within the pocket 108 and a second end 124 which is attached to the lead post 114. Such a configuration may be used, for example, as a sound barrier wherein the first partition 118A acts as a primary barrier, the second partition 118B acts as a secondary barrier, and the space 126 between the two partitions 118A and 118B acts as an insulator or a buffer zone.

In securing the two doors 102A and 102B to one another, a mechanical latch 128 has conventionally been used. For example, referring to FIGS. 3A, 3B and 4 in conjunction with FIG. 1, one or more latches 128 may be positioned at the leading edge of the lead post 114. When the two doors 102A and 102B are drawn together, the latch or latches 128 may be aligned with associated openings 130 in a front plate 134 (or other structure) of the corresponding female lead post 116 (or door post 116') and inserted therethrough. A handle 132 or other structure may be mechanically coupled with the latches 128 such that actuation of the handle 132 results in a desired displacement of the latches 128. For example, vertical displacement of the handle 132 may result in the concurrent and proportional vertical displacement of the latches 128 such that the latches, having been inserted through the openings 130, are displaced relative the openings 130 and wedge against the back surface of the front plate 134 of the lead post 116 to effectively interlock therewith and prevent the two doors 102A and 102B from being displaced away from one another. The latches 128 may subsequently be displaced in an opposite direction to enable withdrawal of the latches 128 from the openings 130 and to allow the displacement of the two doors 102A and 102B away from each other so that they may each be retracted back into their associated pockets 108 for storing.

As shown in FIGS. 1 and 4, latches 128 are conventionally formed as structural components, such as hooks or hook-like structures, which protrude from the leading edge of the lead post 114. Such a configuration is often considered unsightly when the doors 102A and 102B are not secured to one another in a closed or deployed state. Such structures can also be an injury hazard as they can catch on a person's clothing or body. Additionally, alignment of such latches 128 with corresponding openings 130, and displacement of the latches 128 once inserted with such openings often requires considerably more effort than might be expected and may be difficult to accomplish for individuals that don't exhibit substantial strength. For example, in larger structures where the height of the doors 102A and 102B are significant, and where multiple hooks are employed, it can sometimes be difficult to align each latch 128 with each corresponding opening 130 in both the longitudinal direction (i.e., along the direction in which the track 112 extends), in a lateral direction (i.e., a direction substantially transverse to the direction in which the track 112 extends) or both.

The present invention includes various embodiments of mechanisms and methods of securing movable partitions including securing individual components of movable partitions relative to one another or relative to another structure such as, for example, the wall of a building.

BRIEF SUMMARY OF THE INVENTION

The present invention is directed to movable partitions and securing such partitions in a closed or deployed state. In accordance with one embodiment of the present invention, a partition system is provided. The system includes at least one door having at least one foldable partition coupled with a first post member. A first structure is coupled with the first post member. A second post member is configured for mating engagement with the first post member. A second structure is coupled with the second post member, wherein the first structure and second structure are located and configured for selective magnetic coupling with one another when the first post member and second post member are engaged. In one embodiment, the first structure may include a ferrous structure and the second structure may include a magnet.

In accordance with another embodiment of the present invention, a method is provided for operating a partition system having at least one foldable partition coupled with a first post member and a second post member configured for mating engagement with the first post member. The method includes displacing a first post member of a first foldable partition and engaging a second post member with the first post member. A first structure associated with the first post member is aligned with a second structure associated with the second post member and the first structure is magnetically coupled with the second structure.

In accordance with yet another embodiment of the present invention, a magnetic latch assembly configured to secure a first post member and a second post member of a partition system is provided. The assembly includes a ferrous structure configured to be slidingly coupled with the first post member of the partition system. A magnetic structure is configured for coupling with the second post member of the partition system. The magnetic structure includes a housing, a magnet disposed partially within the body, a clamping structure located and configured to apply a clamping force through the housing to the magnet, and a pivot coupled to a portion of the housing and to a bracket configured for coupling with the second post member, wherein the pivot and bracket are cooperatively sized and configured to enable the magnet to move relative to the bracket in a direction along a first axis and in at least a second direction along a second axis.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
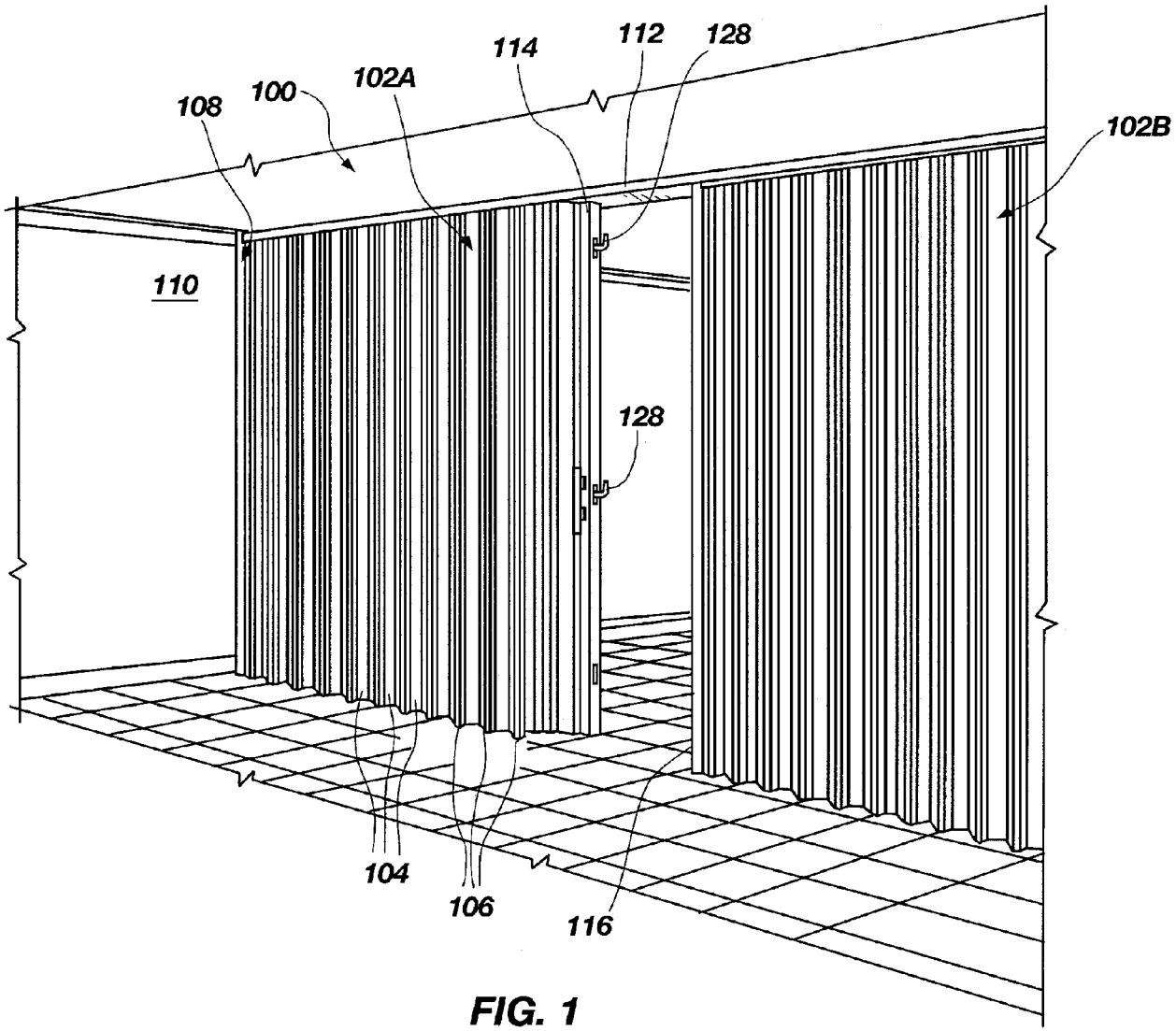
FIG. 1 is a perspective view of a prior art partition system.
Figure 2A:
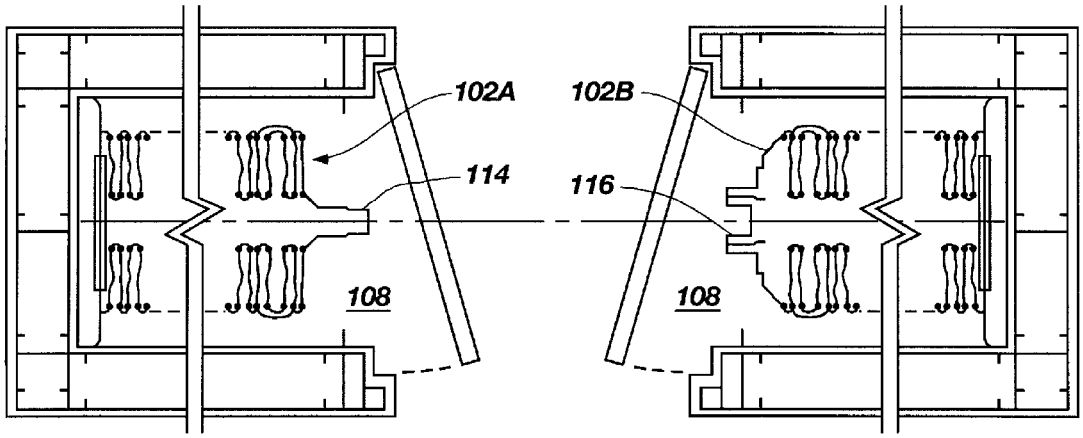
FIGS. 2A and 2B are plan views of prior art partitions.
Figure 2B:
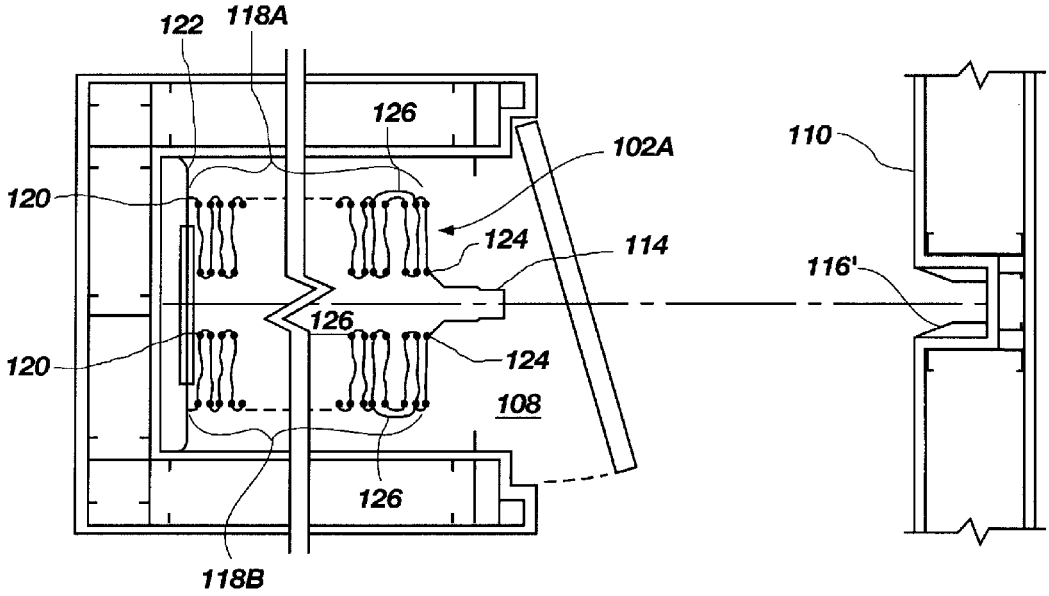
Figure 3A:
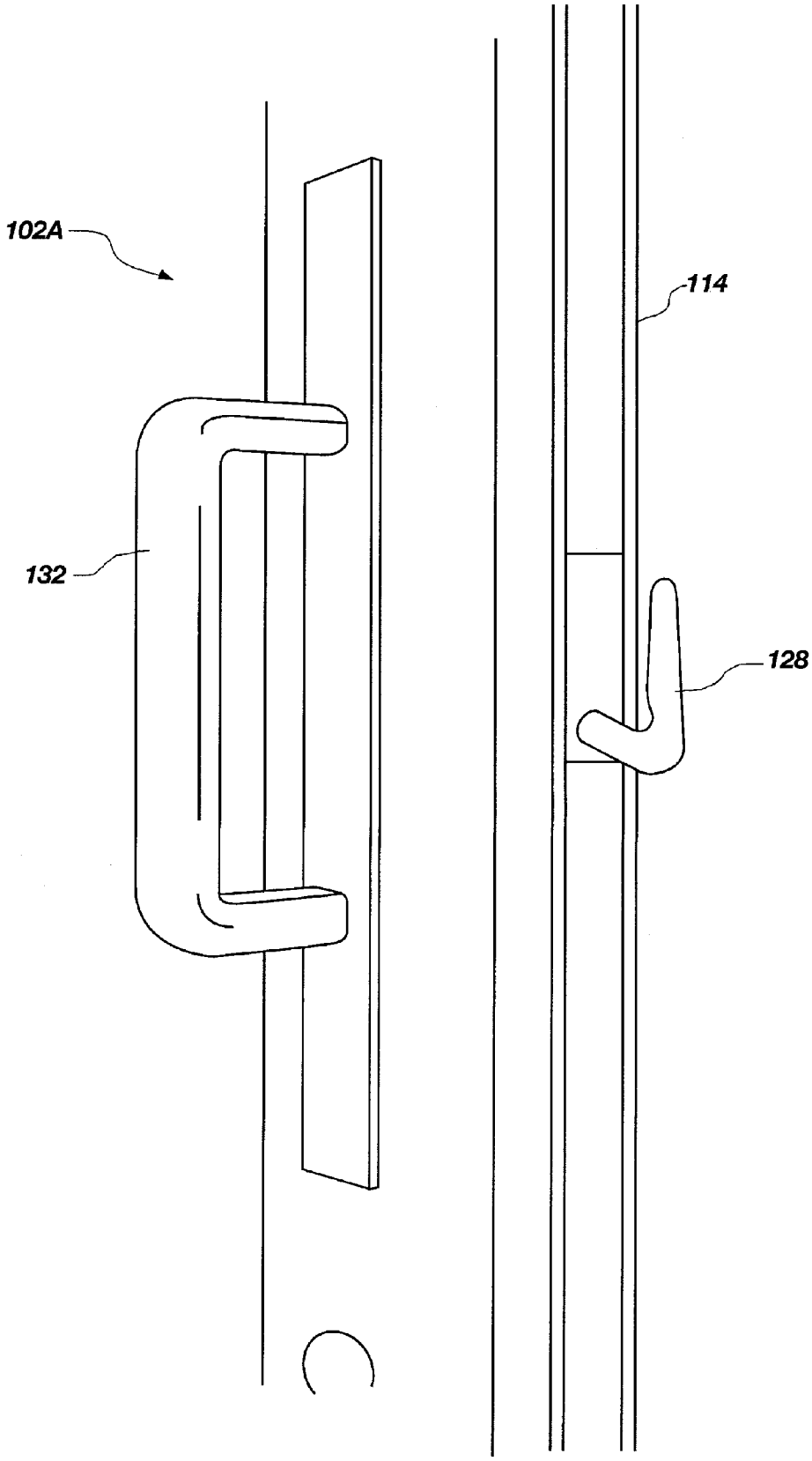
FIGS. 3A and 3B are enlarged perspective views of portions of the partition shown in FIG. 1.
Figure 3B:
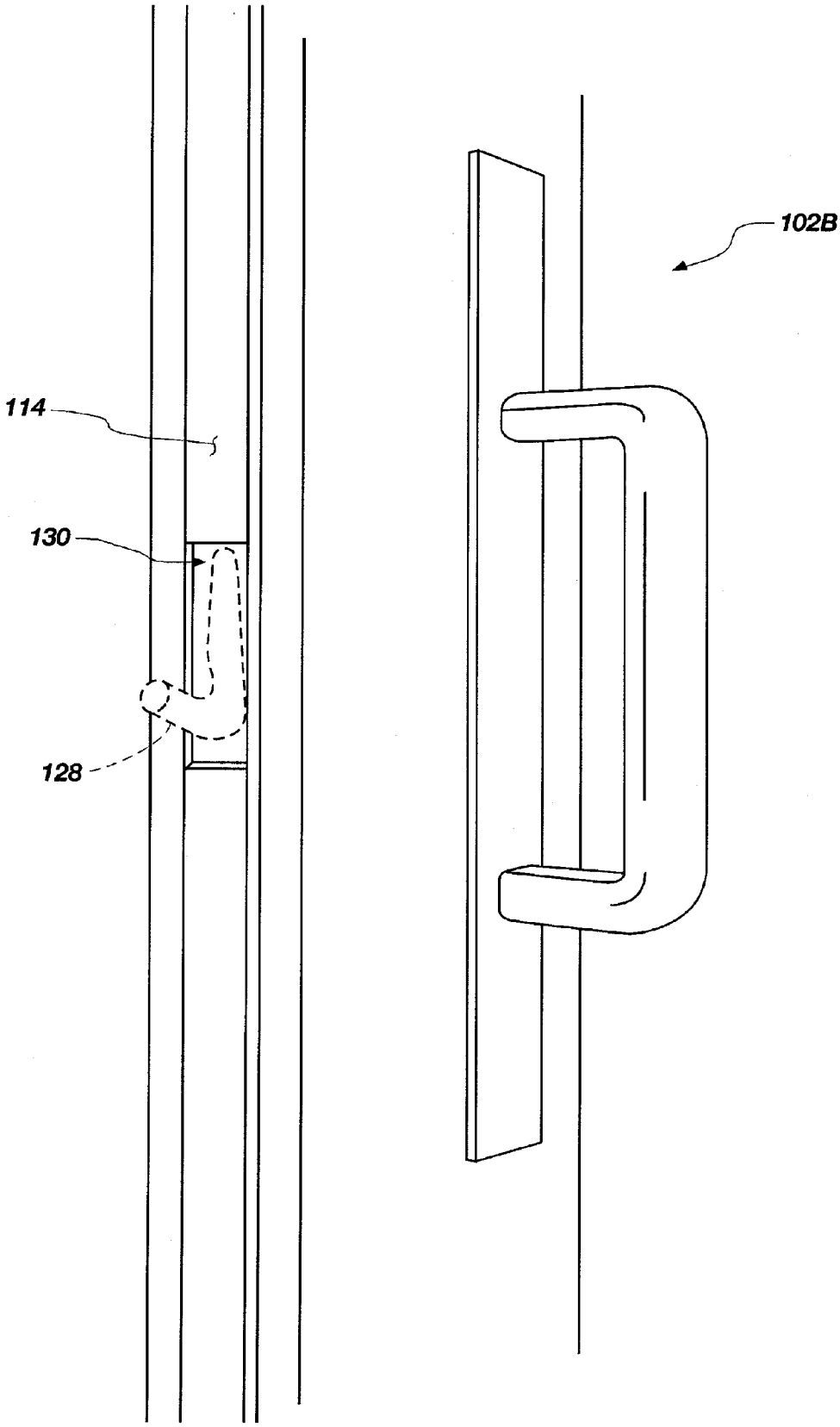
Figure 4:
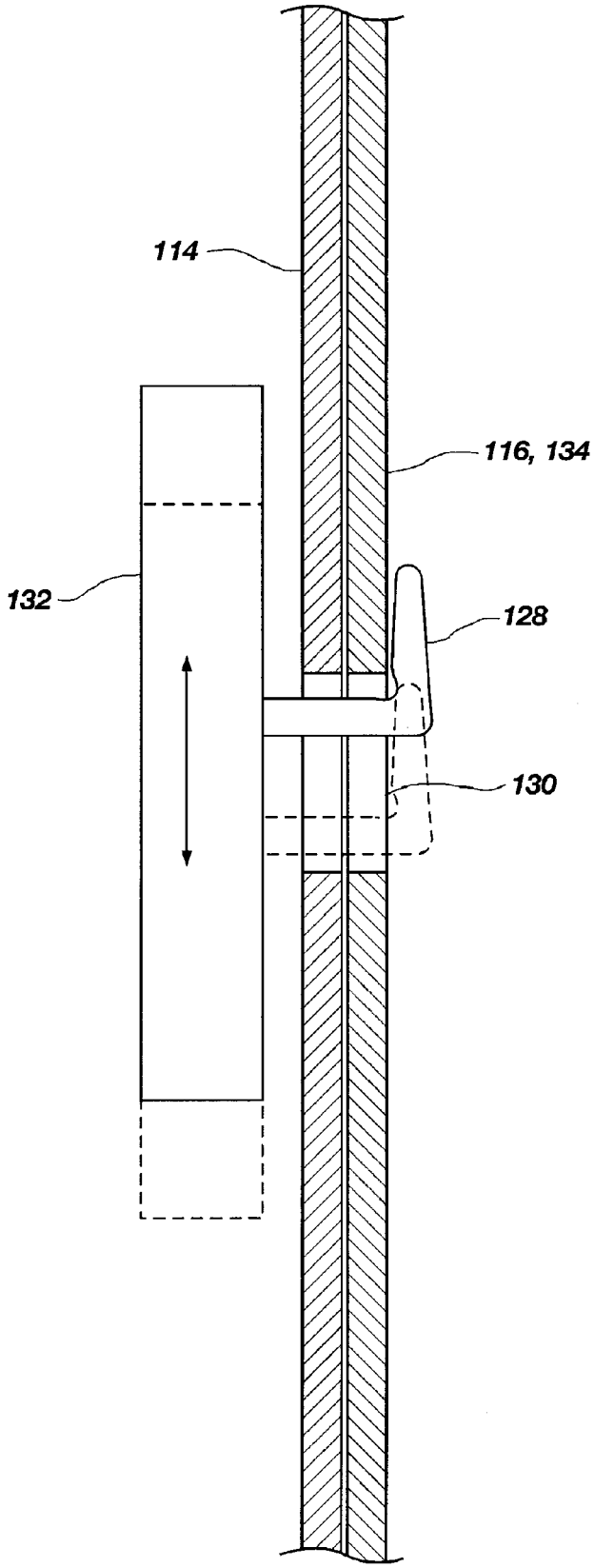
FIG. 4 is a partial cross-sectional view of the partition shown in FIG. 1 when in a secured state.
Figure 5:
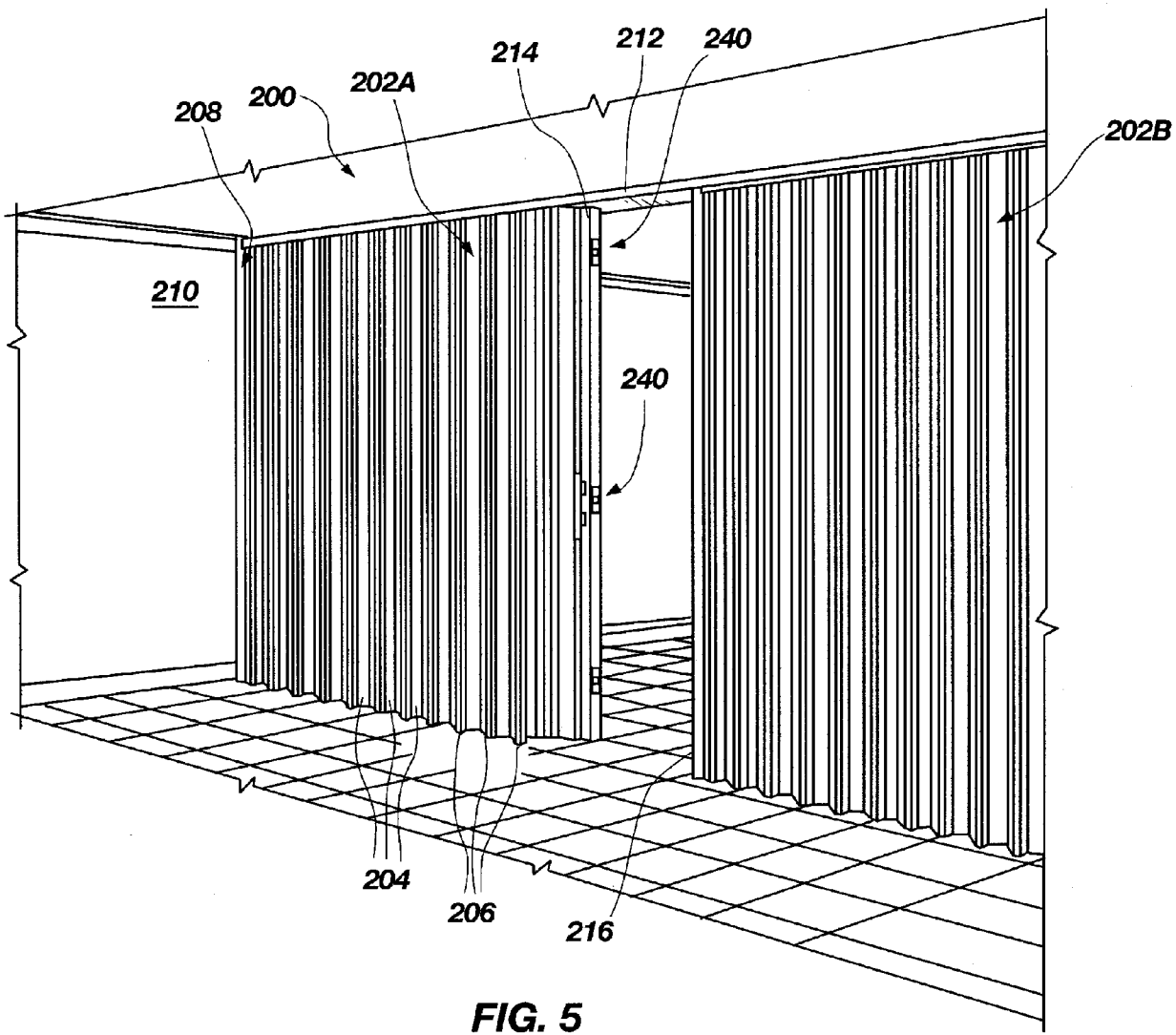
FIG. 5 is a perspective view of a partition system in accordance with an embodiment of the present invention.

Referring to FIG. 5, a movable or folding partition system 200 is shown in accordance with an embodiment of the present invention. The partition system 200 includes a number of components that are similar to that which has been described above in association with FIGS. 1, 2A and 2B. For example, the partition system includes one or more foldable or accordion-type doors 202A and 202B which may be used to enclose an area or subdivide a space into multiple, smaller spaces. The doors 202A and 202B may be formed with a plurality of panels 204 which are connected to one another with hinges 206 or other hinge-like structures. The hinged connection of the panels 204 enables the panels to fold and stack adjacent one another in an accordion or plicated manner such that the doors 202A and 202B may be compactly stored. For example, doors 202A and 202B may be compactly stored in pockets 208 formed in the walls 210 of a building when the doors 202A and 202B are in a retracted or folded state. In other embodiments pockets 208 may not be formed on the walls 210 and the doors 202A and 202B may be mounted directly to the walls 210 and stored proximate the walls 210 in a retracted and folded state. When the doors 202A and 202B are deployed to subdivide an area, the doors 202A and 202B may be displaced along a track 212 to provide the desired barrier.

As shown in FIG. 5, two doors 202A and 202B may be utilized wherein each extends from its associated pocket 208 to cooperatively mate with one another. As previously discussed, such a configuration may be referred to as a bi-part configuration. The first door 202A includes a lead post 214 which is configured to cooperatively mate with the lead post 216 of the second door 202B when each door is properly extended. For example, one lead post may be configured as a so-called male lead post while the other may be configured as a so-called female lead post. In another embodiment, and as previously discussed, the partition system 200 may comprise a single door that mates with a stationary structure to form a barrier. For example, a single door (e.g., 202A) may include a male lead post which is configured to mate with a female door post (not shown in FIG. 5) formed in a wall or other structure. As will become apparent upon further discussion, in certain embodiments such lead posts may also be referred to as latch posts or magnet posts.

The partition system 200 may include one or more securing mechanisms to maintain the two doors 202A and 202B relative to each other in a closed state, or to secure a single door relative to some other structure (e.g., a wall) in a closed state. The partition system 200 may be configured to be manually operated, automatically operated, or a combination thereof. For example, the partition system 200 may require one or more operators to extend the doors 202A and 202B to form a barrier or to retract the doors 202A and 202B to a stowed position. Additionally, the partition system 200 may require an operator to activate one or more latch mechanisms as will be discussed in further detail hereinbelow.

In additional embodiments the partition system 200 may be configured with electric motors, or other mechanisms, such that the doors 202A and 202B may be extended to form a barrier or retracted to a stowed position in a substantially automatic manner. Optionally, the partition system 200 may include mechanisms such as electric solenoids so that one or more latch mechanisms or other mechanisms or components may be activated automatically. It is noted that while the following discussion of securing mechanisms is largely described in terms of two doors, or bi-part configurations, the use of the described securing mechanisms is clearly applicable to single door configurations, as well as configurations having three or more doors, as will be appreciated by those of ordinary skill in the art.

Figure 6A:
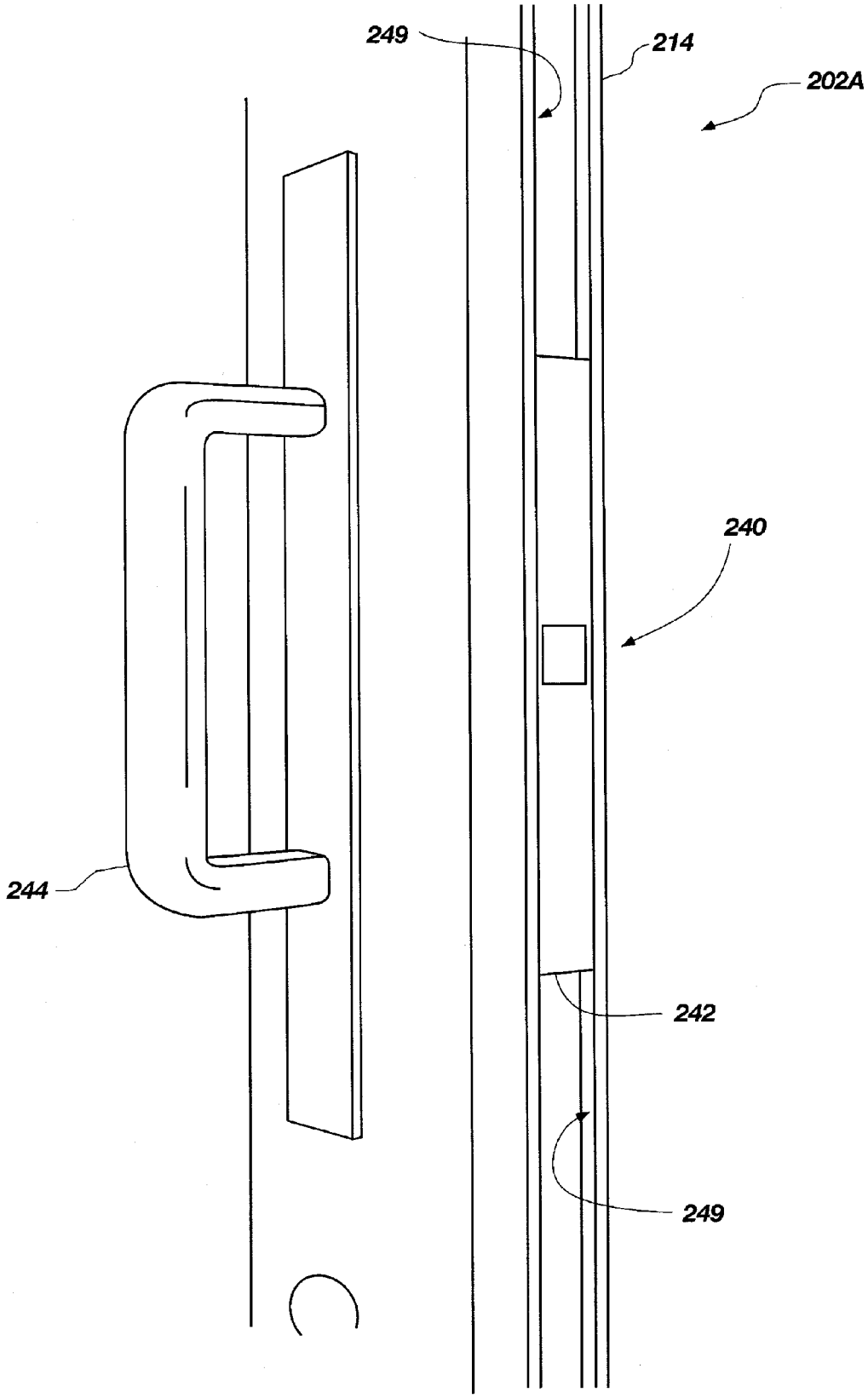
FIGS. 6A and 6B are enlarged perspective views of portions of the partition shown in FIG. 5.
Figure 6B:
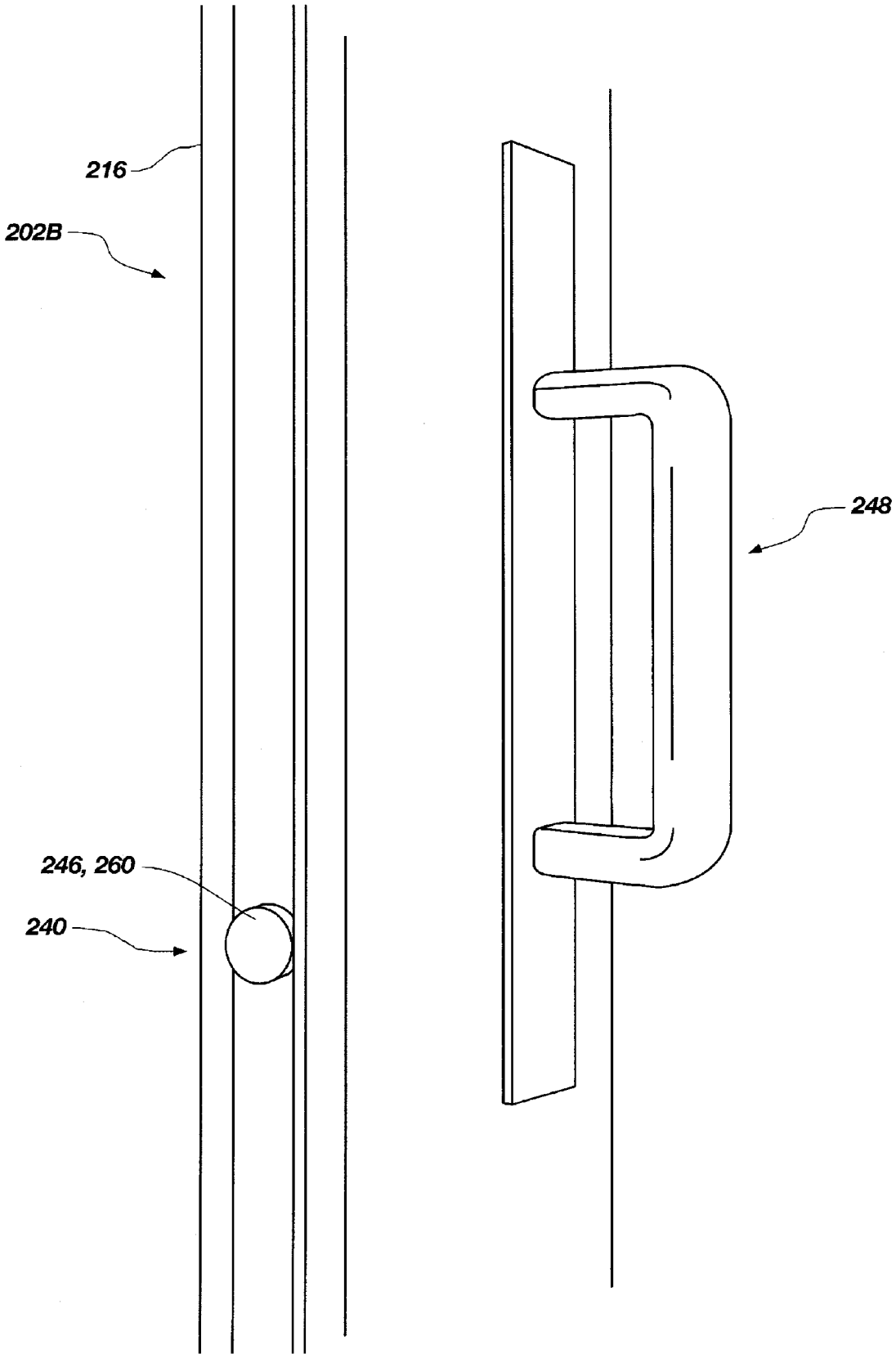

For example, referring briefly to FIGS. 6A and 6B in conjunction with FIG. 5, according to one embodiment of the present invention, one or more magnetic securing mechanisms 240 may be utilized to secure the two doors 202A and 202B relative to one another. FIG. 6A is a perspective view of a leading edge of a first door (e.g., 202A) showing the lead post 214 associated therewith. FIG. 6B is a perspective view of a leading edge of a second, associated door (e.g., 202B) having a lead post 216 configured to matingly engage the lead post 214 of the first door 202A. The first door 202A may include one or more components of the securing mechanism 240 such as, for example, a latch plate 242. Additionally, as will become apparent upon further description below, the latch plate 242 may be coupled to a handle 244 or other structure that is selectively displaceable relative to the associated lead post 214.

The second door 202B may also include one or more components of the securing mechanism 240 such as, for example, a magnetic structure 246 or assembly. It is noted that the handle 248 shown in FIG. 6B may be a fixed or stationary structure used to pull or displace the associated door 202B, but not necessarily used to displace the magnetic structure 246 relative to the lead post 216. However, in another embodiment, it is contemplated that the handle 244 associated with the first door 202A may be fixed relative to the lead post 214 (and thus the latch plate 242 may be fixed relative to the lead post 214) while the handle 248 associated with the second door 202B may be configured to selectively displace the magnetic structure 246 relative to the associated lead post 216.

Figure 7A:
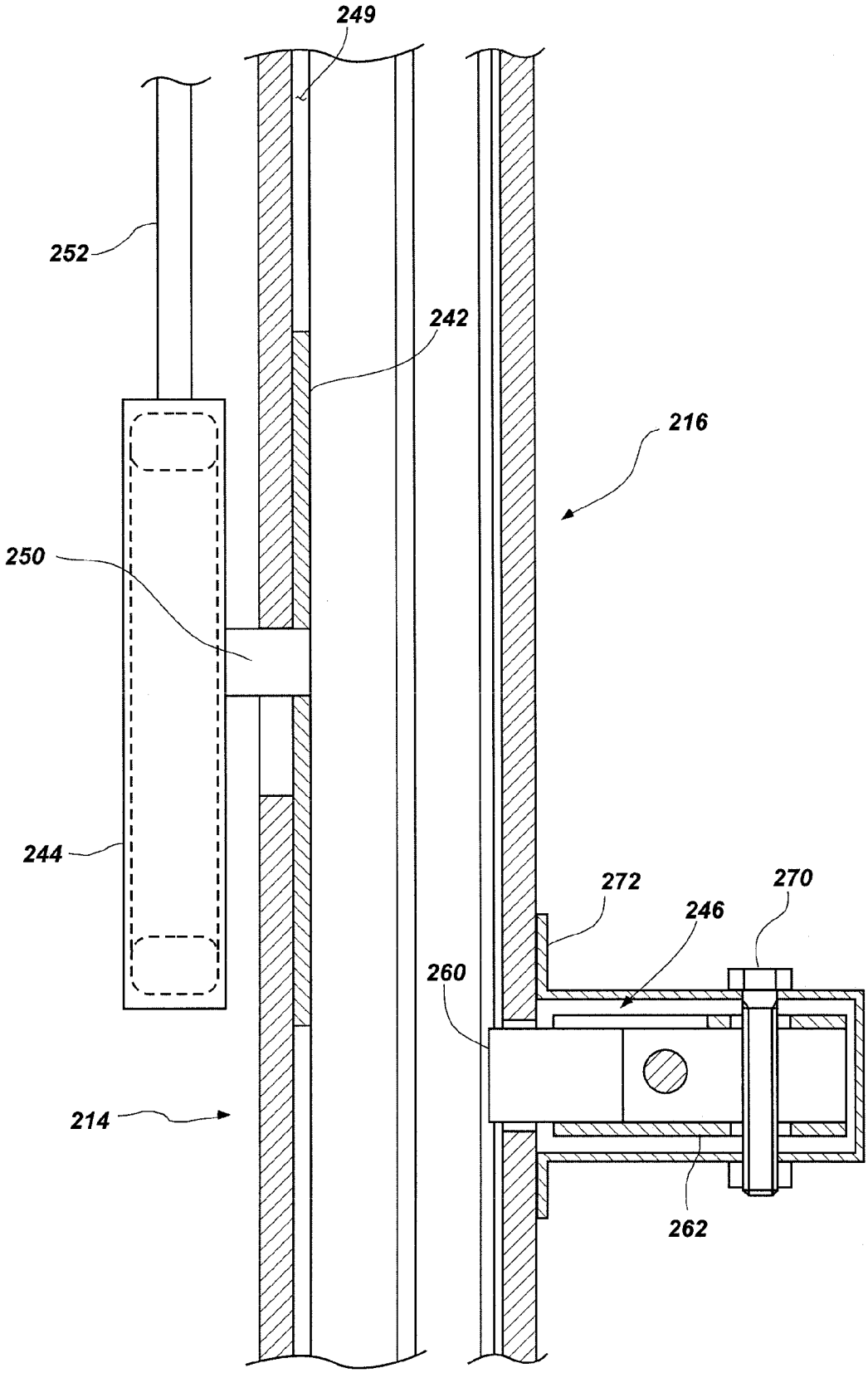
FIGS. 7A through 7C are partial cross-sectional views of portions of the partition system shown in FIG. 5 in accordance with an embodiment of the present invention.
Figure 7B:
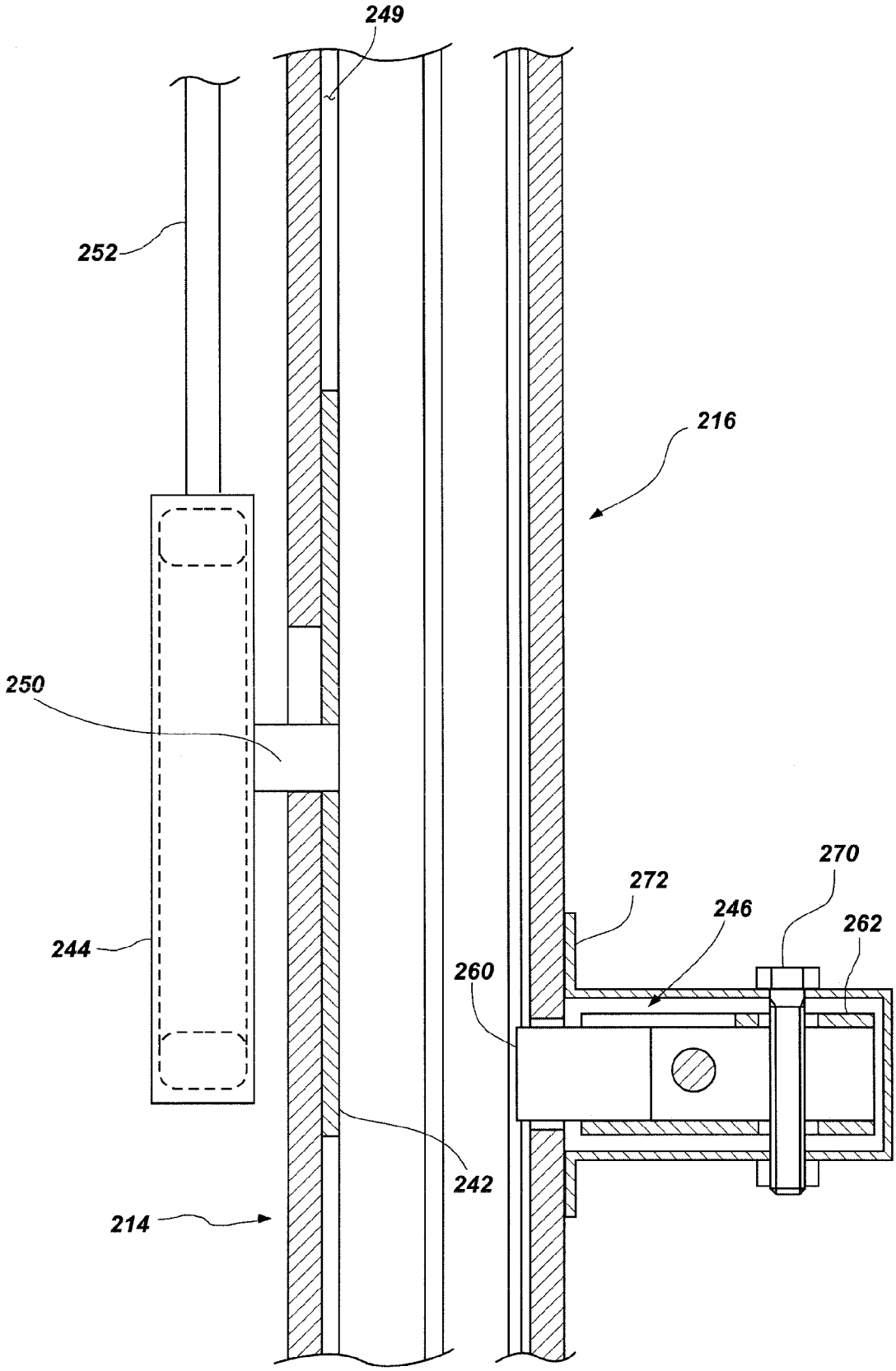
Figure 7C:
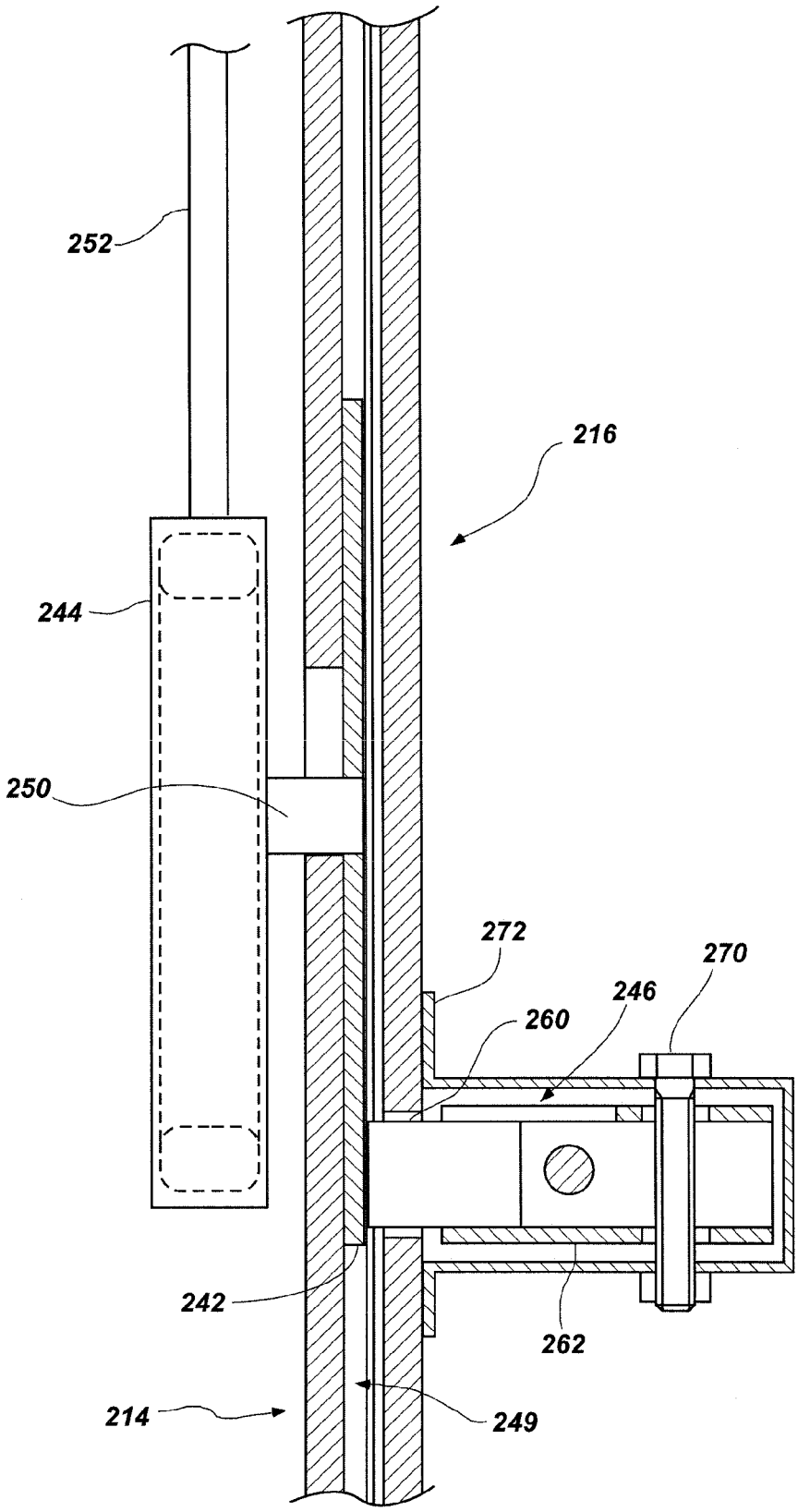

Referring to FIGS. 7A through 7C in conjunction with the previously discussed drawing figures, FIG. 7A shows the lead posts 214 and 216 of the two doors 202A and 202B positioned adjacent one another prior to securement of the two doors 202A and 202B. The latch plate 242, which is slidingly disposed within grooves 249 within the lead post 214, is in a first position wherein it is not aligned with an adjacent magnetic structure 246. The handle 244 is coupled with the latch plate 242 by way of an appropriate structure 250 such that, in one embodiment, displacement of the handle 244 relative to the lead post 214 results in the concurrent and proportional displacement of the latch plate 242. Thus, displacement of the handle 244 or other actuating mechanism moves the latch plate 242 and positions at least a portion thereof into alignment (or out of alignment depending on the direction of displacement) with the associated magnetic structure 246 for securement of the doors 202A and 202B as will be discussed in further detail below.

As also seen in FIG. 7A, a strut 252 or other structural component may be coupled with the handle and configured for displacement upon associated displacement of the handle 244. The strut 252 may be coupled with one or more additional latch plates (not shown in FIG. 7A) and configured to displace them a similar manner to that which has been already described. Additionally, while specifically depicted as extending upwardly from the handle 244, the strut 252 may extend downwardly to an associated latch plate or other structure, or the strut 252 may extend both upwardly and downwardly from the handle 244 to additional latch plates 242 or other associated structures or mechanisms.

As seen in FIG. 7A, the latch plate 242 may be placed in a disengaged position relative to the magnetic structure 246. In other words, the latch plate 242 may be placed in a position that is generally out of lateral alignment (e.g., vertical alignment as depicted in FIG. 7A) with the magnetic structure 246 when in the disengaged position. However, as seen in FIG. 7B, displacement of the handle 244 results in associated displacement of the latch plate 242 such that it becomes aligned with the magnetic structure 246 and placed in an engaged or engaging position.

The magnetic structure 246 provides a magnetic flux that attracts the latch plate 242 to the magnetic structure 246. As shown in FIG. 7C, the magnetic attraction between the latch plate 242 and the magnetic structure 246 results in the lead posts 214 and 216 of the two doors 202A and 202B being secured to one another such that the two doors 202A and 202B remain in a closed position when the latch plate is in an engaged position and a magnetic circuit has been established between the magnetic structure 246 and the latch plate 242. To disengage the two lead posts 214 and 216 from one another, the latch plate 242 may be displaced so that it is no longer laterally aligned with the magnetic structure. The magnetic circuit between the latch plate 242 and magnetic structure 246 is then defeated (or at least sufficiently weakened) such that the two lead posts 214 and 216 may be displaced away from one another with relatively little force being exerted.

Figure 8:
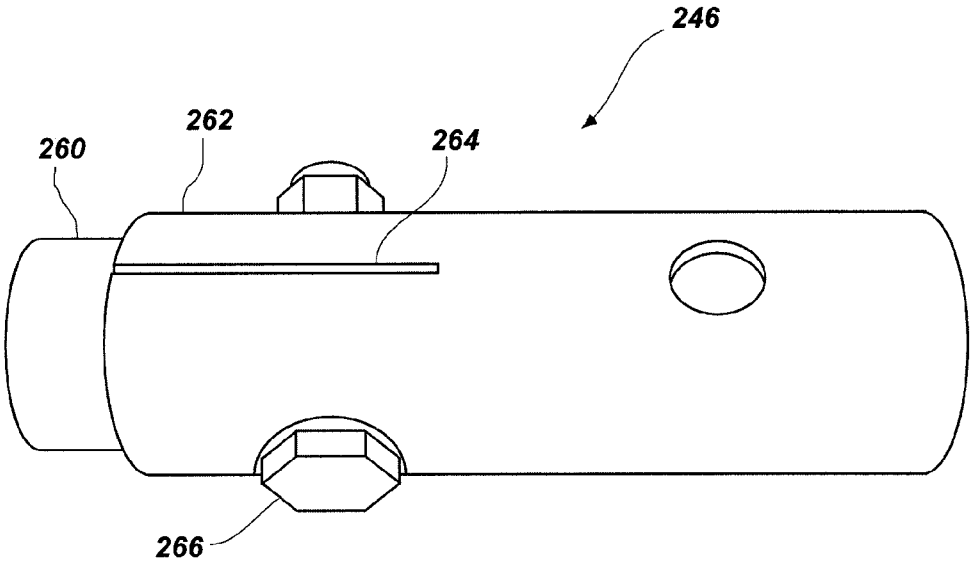
FIG. 8 shows a component assembly used in conjunction with the partition system of FIG. 5 according to an embodiment of the present invention.
Figure 9:
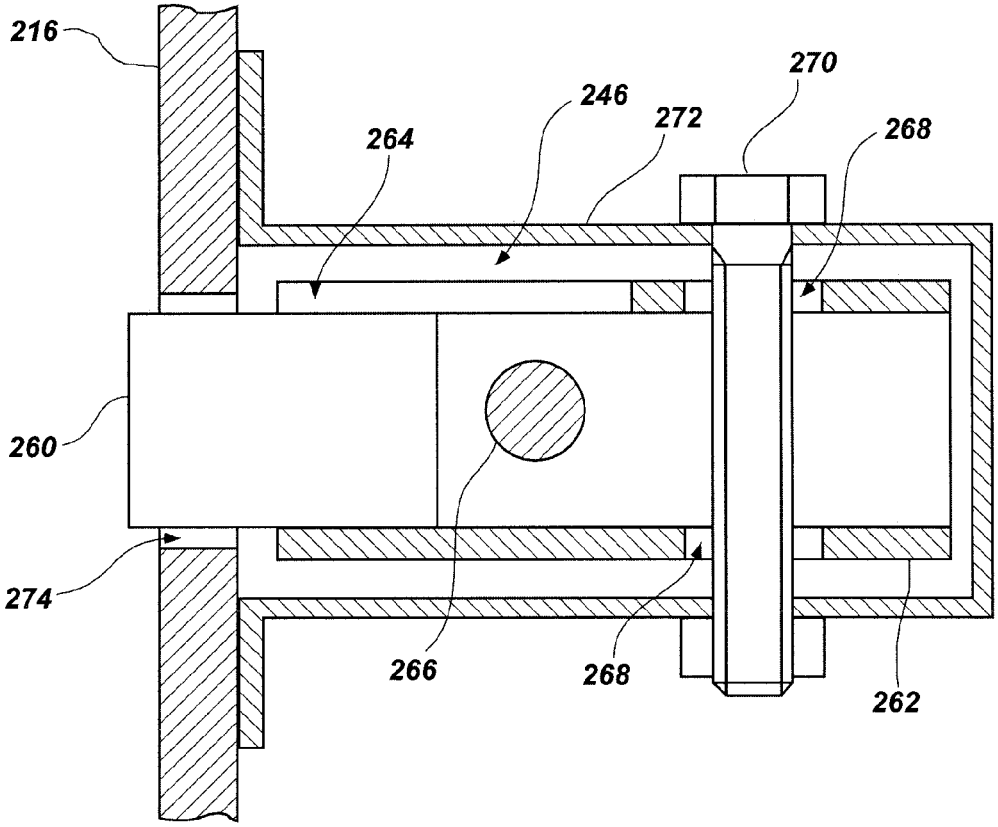
FIG. 9 is an enlarged partial cross-sectional detail of a component assembly shown in FIGS. 7A through 7C.

Referring to FIGS. 8 and 9 in conjunction with FIGS. 7A through 7C, additional details are shown regarding an example of a magnetic structure 246. The magnetic structure 246 includes a magnet 260 disposed in a housing member 262. In one embodiment, the internal cross section of the housing member 262 is similar in geometry and size as the outer cross section of the magnet 260 such that the magnet 260 may be cooperatively received within the housing member 262. The housing member 262 has a slot 264 formed in the same end in which the magnet 260 is disposed. A fastening member 266, such as a matched nut and bolt, may be used to clamp the magnet 260 within the housing member 262. The slot 264 enables a desired amount of deformation to take place within the housing member 262 when the fastening member 266 is tightened so that nominal size differences between the housing member 262 and the magnet 260 may be accounted for and so that a sufficient clamping force may be applied by the housing member 262 to the magnet 260.

The housing member 262 also includes apertures or openings 268 formed therein for receipt of a fastening member 270. For example, as seen in FIGS. 7A through 7C and FIG. 9, a fastening member 270 may be coupled to a bracket 272 and extend through the openings 268 of the housing member 262 acting as a pivot for the housing member 262. The bracket 272 may be coupled to the lead post 216 by any appropriate means (e.g., mechanical fasteners, adhesives, welding, brazing or the like) to position the magnet 260 within an opening 274 formed in the lead post 216. The fastening member 270, the bracket 272 and the openings 268 formed within the housing member are cooperatively configured to enable the housing member 262 (and thus the magnet 260) to pivot and float relative to the bracket 272 and the lead post 216 within defined limits.

The opening 274 formed in the lead post 216 is sized and configured such that the magnet 260 extends therethrough with additional clearance, providing the magnet 260 with a limited amount of space to move in one or more directions (e.g., side to side, up and down, or a combination thereof) relative to the lead post 216. Additionally, the opening 274 formed in the lead post 216 is sized and configured such that the housing member 262 will not extend therethrough, but rather abuts the surrounding portions of the lead post 216 when the magnet 260 extends a specified distance through the opening 274. Thus, the magnet 260 is configured to float within a predefined spatial zone or volume relative to the lead post 216. The ability of the magnet 260 to float relative to the lead post 216 enables better alignment of the magnet 260 with the latch plate 242 and ensures maximum surface contact therebetween when they are engaged with one another.

Referring generally to FIGS. 5 through 9, in one example embodiment, the securing mechanism 240 may include a latch plate 242 formed of iron or another ferromagnetic material. The magnetic structure 246 may include a magnet 260 formed as a neodymium magnet or other rare earth magnet. When properly engaged with one another, the magnet 260 and latch plate 242 may be sized and configured to resist approximately 70 pounds of force (i.e., with the lead posts 214 and 216 being pulled away from each other in a direction along the track 212) without separating. In some applications, for example where physical activities (e.g., basketball, volleyball and the like) may be conducted in close proximity to the doors 202A and 202B, it can become important for the securing mechanism(s) 240 to withstand substantial lateral forces (e.g., such as a player running into or being pushed into the doors 202A and 202B) without the doors 202A and 202B separating from one another.

As noted above, multiple latch plates 242 and corresponding magnetic structures 246 may be used in a single partition system 200 depending, for example, on the size of the door and the anticipated activities that will be conducted in the proximity of the doors 202A and 202B. For example, a door exhibiting substantial height (e.g., 8 feet or greater) may utilize more than one securing mechanism 240. In some cases, three or four corresponding pairs of latch plates 242 and magnetic structures 246 may be desired.

Embodiments of the present invention, such as the magnetic securing mechanism 240, provide a variety of advantages over prior art methods of latching or securing movable partitions. For example, the incorporation of a magnetic securing mechanism 240 eliminates the structural protrusions associated with mechanical "hook" or "wedge" type latches. The use of such latching mechanisms is considerably more aesthetically pleasing than prior art hook mechanisms and reduces potential hazards created by protruding structures.

Additionally, the use of magnetic latch mechanisms assist with alignment and securement of the two doors 202A and 202B when they are being latched together whereas, with mechanical type locking mechanisms, unless both lead posts are precisely aligned prior to joining thereof, the mechanical latching structures sometimes impede securement of the doors 202A and 202B. In other words, the attraction forces of the magnetic latch mechanisms draw the lead posts 214 and 216 together in a desired alignment rather than requiring an operator to perform such alignment of the lead posts.

Moreover, the use of the structures and mechanisms described above provide secure and positive latching of the lead posts which is a desirable quality in both maintaining the doors 202A and 202B in a secure state as well as enhancing the sound reduction quality of the doors 202A and 202B. Additionally, while the magnets provide sufficient alignment and retaining abilities (which can be tailored to resist a specified level of applied force), the latch is easily disengaged with the simple act of sliding the latch plate 242 relative to the magnet 260 to weaken the magnetic attraction between the various components and which requires relatively little force to be applied by an operator of the partition system 200.

Figure 10A:
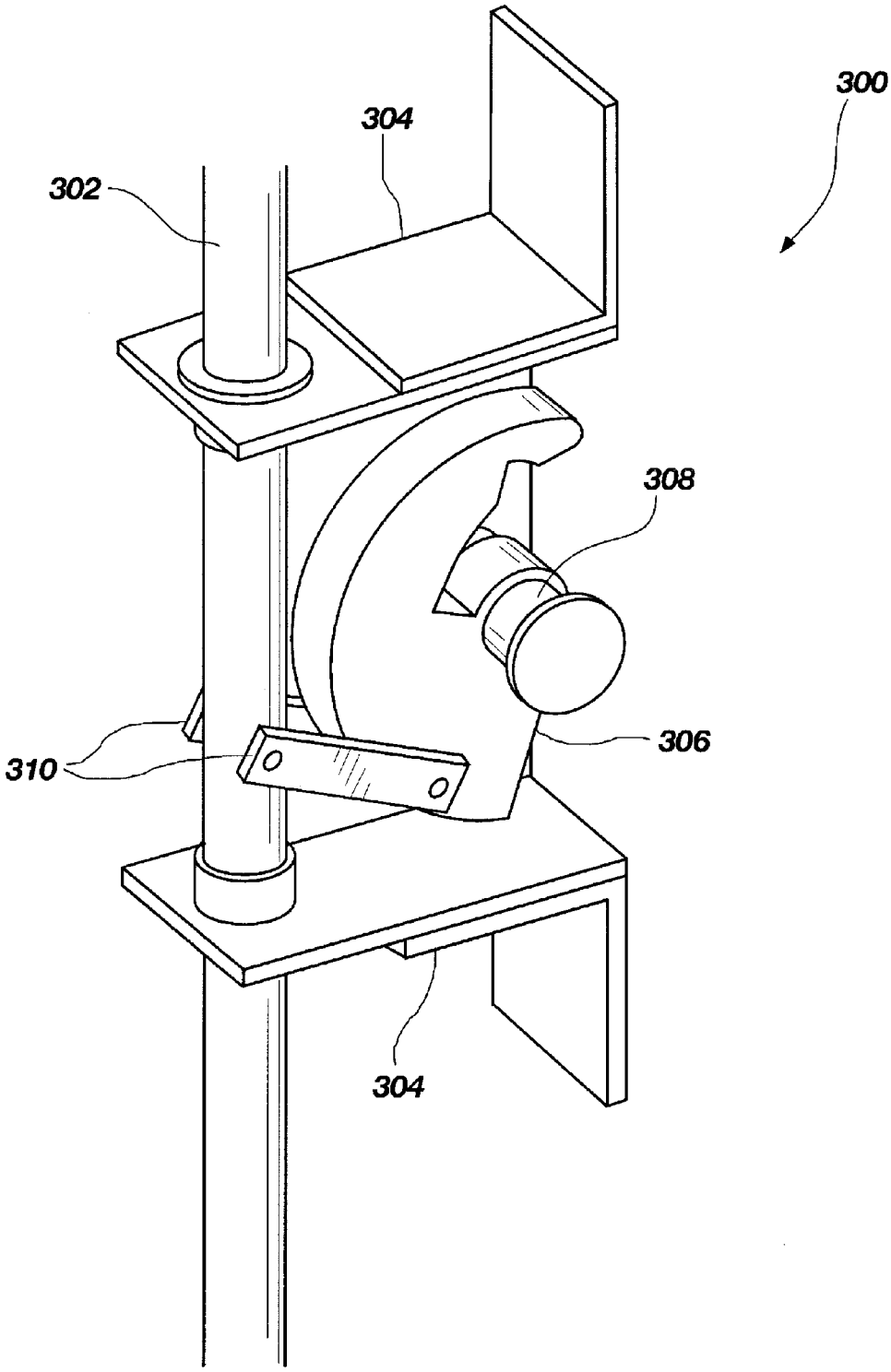
FIGS. 10A and 10B are perspective views of a mechanism that may be used in conjunction with the partition system of FIG. 5 in accordance with an embodiment of the present invention.
Figure 11:
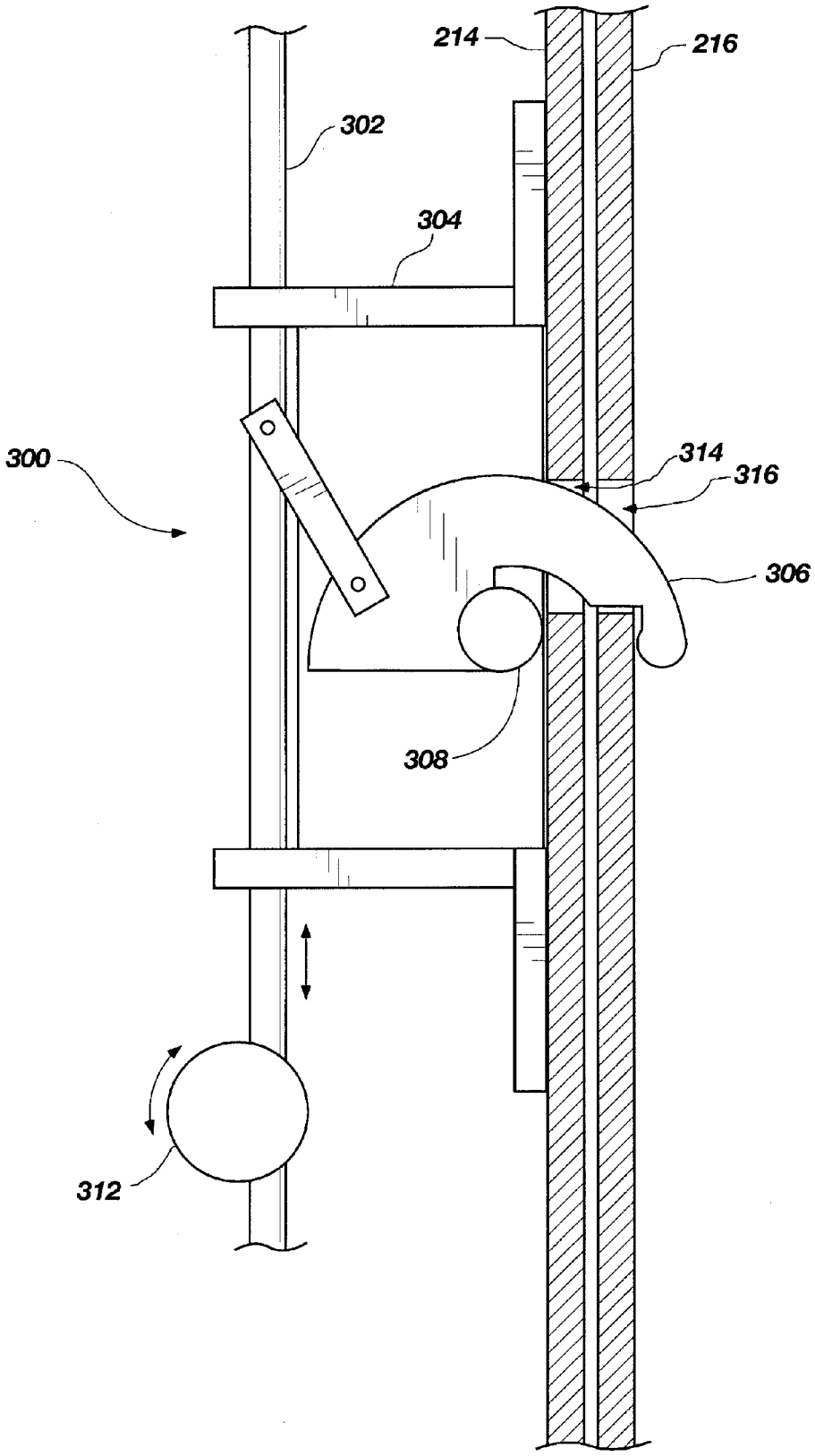
FIG. 11 is a partial cross-sectional view of the mechanism of FIG. 10B in association with a partition system in accordance with an embodiment of the present invention.

Turning now to FIGS. 10A, 19B and 11, another latching mechanism is shown and described. For purposes of convenience and clarity, the mechanism currently described will be referred to as a locking mechanism 300, although, as will be apparent to those of ordinary skill in the art, certain embodiments of the mechanism need not be "locked" in the sense of requiring a key or other similar actuating mechanism to operate.

Figure 10B:
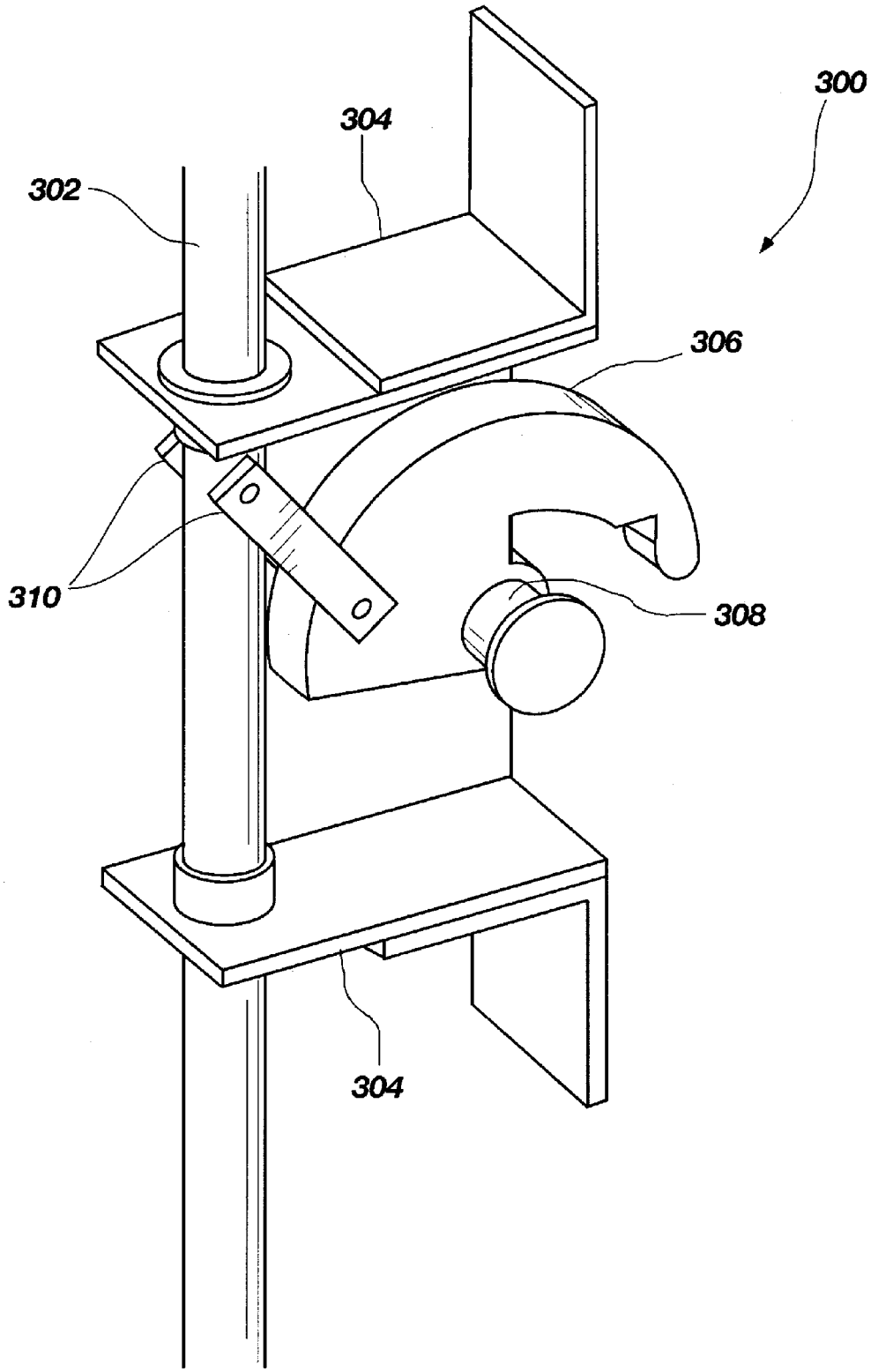

The locking mechanism 300 includes a strut 302 coupled to one or more brackets 304. The bracket 304 (or brackets) is configured to be coupled with, for example, the lead post 214 of a door 202A (see FIG. 5). The bracket 304 may act as a linear bearing for the strut 302 such that the strut 302 may be displaced relative thereto. A cam 306 is configured to rotate about a pin 308, the pin being fixed relative to the bracket 304. One or more linkage members 310 have a first end pivotally coupled with the strut 302 and have a second end pivotally coupled with the cam 306. Upon displacement of the strut 302 relative to the bracket 304, the cam 306 rotates about the pin 308 from a first position, as shown in FIG. 10A, to a second position, as shown in FIG. 10B.

An actuator 312 (FIG. 11) may be used to selectively displace the strut 302 and, therefore, rotate the cam 306 between the first and second positions. In one embodiment, the actuator 312 may include a lock cylinder so that the actuator may not be operated without the use of an appropriate key. However, in other embodiments, the actuator 312 may include a handle or other structure that does not require a key. For example, a rotating handle may be implemented. In other embodiments a sliding handle may be used. In yet another embodiment, the strut 302 may be coupled with a handle 244 (FIG. 6A) associated with a magnetic latching mechanism 240 such that the latching mechanism 240 and locking mechanism are activated substantially simultaneously.

As seen in FIG. 11, when the cam 306 has been actuated from the first position (FIG. 10A) to the second position (FIG. 10B), a portion of the cam 306 extends through an opening 314 in the associated lead post 214, through a corresponding opening 316 in an adjacent lead post 216, to mechanically secure the two lead posts 214 and 216 to each other by positioning an end of the cam 306 such that it may not be retracted through the opening 316 of the lead post 216 without being actuated back to the first position (i.e., the position shown in FIG. 10A). In such a case where the locking mechanism 300 operates independently of the magnetic latching mechanism 200, the locking mechanism 300 may be used to independently ensure that the two doors 202A and 202B (FIG. 5) remain in a closed position. Thus, even if a force was applied to the doors 202A and 202B that was strong enough to defeat the magnetic forces applied by the magnetic latches, the locking mechanism 300 would, absent structural failure of one or more components, prevent the doors 202A and 202B form being displaced away from one another. Moreover, as noted above, when implemented with a key cylinder or other similar actuator 312, such a locking mechanism provides the desired security of maintaining the doors 202A and 202B in a closed, locked state unless an authorized individual affirmatively unlocks and opens the doors 202A and 202B.

Figure 12:
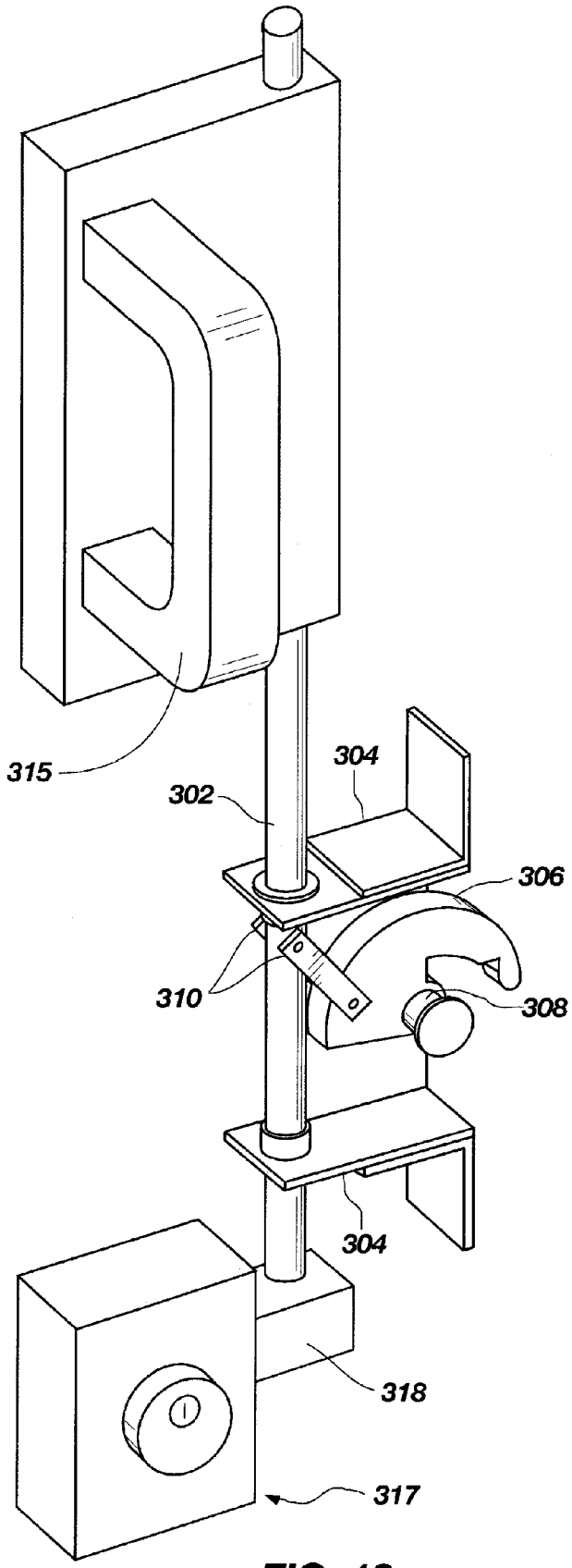
FIG. 12 is a perspective view of a mechanism that may be used in conjunction with the partition system of FIG. 5 in accordance with an embodiment of the present invention.

FIG. 12 shows and additional embodiment, including a handle 315 and a lock mechanism 317. The strut 302 may be structurally coupled to the handle 315, such that an operator may displace the strut 302 and rotate the cam 306 by displacing the handle 3A handle 315. When the strut 302 is displaced such that the cam 306 is rotated into the second position, as shown in FIG. 12, the lock mechanism 317 may be actuated. When the lock mechanism 317 is actuated, an interference member 318 may extend from the lock mechanism 317 and limit the movement of the strut member 302. This may prevent an operator from displacing the strut member 302 beyond a predetermined location and prevent the cam 306 from rotation back to the first position (as shown in FIG. 10A). The lock mechanism 317 may be actuated, for example, by rotating a key (not shown) or by another mechanical or electrical means, such as for example by a rotating handle, a sliding handle, a lever, an electromechanical solenoid, an electric motor or some combination or such mechanisms.

Figure 13A:
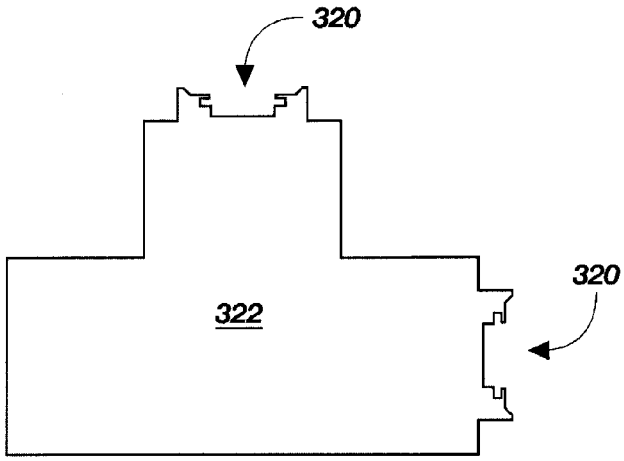
FIGS. 13A through 13C are cross-sectional views of multi-meeting posts that may be used in a partition system according to embodiments of the present invention.
Figure 13B:
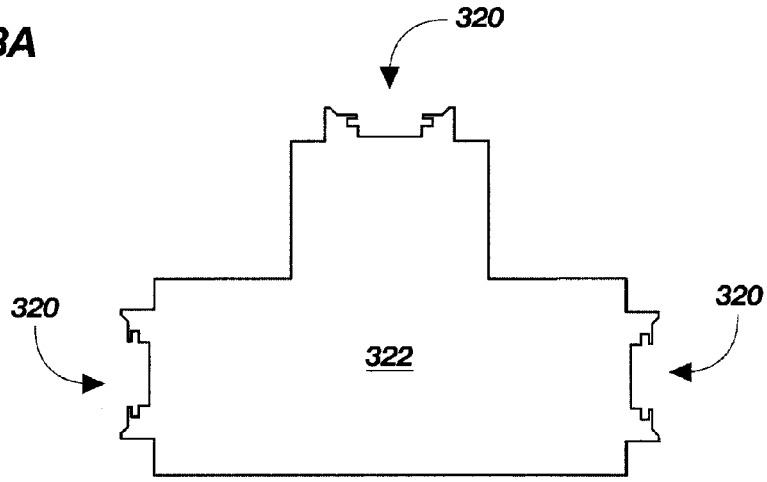
Figure 13C:
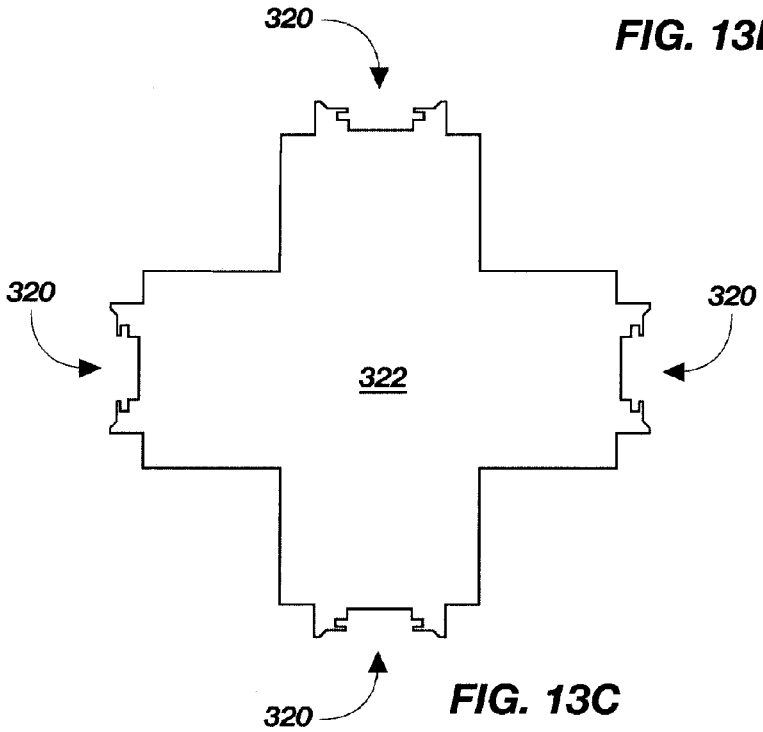

In additional embodiments, the apparatuses and associated methods previously described herein with reference to FIGS. 5-12 may be incorporated in a multi-meeting partition assembly including two or more doors. A multi-meeting partition assembly may include a multi-meeting post 322 as shown in FIGS. 13A-13C. The multi-meeting post may be configured with multiple receiving locations 320 that may each be configured to mate with the lead post on a corresponding door. The multi-meeting post 322 may be configured so that two or more doors may meet at an angle. For example, two doors may meet at a ninety-degree angle as shown in FIG. 13A. In additional embodiments, three doors or more may meet at a single multi-meeting post 322, as shown in FIGS. 13B-13C. When using such multi-meeting posts 322, they may be configured, for example, similar to the lead posts 216 described with respect to FIGS. 6B, 7A, 7B and 9, having a securing mechanism 240, such as a magnetic structure 246 may be installed therein and configured for mating and securing with a latch plate 242 in an associated door such as has been described hereinabove. Additionally, the multi-meeting posts 322 may be configured for engagement with a locking mechanism 300 such as has also been described hereinabove.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A partition system comprising:

at least one door having at least one foldable partition coupled with a first post member;

a first structure formed of a ferrous material, the first structure including a plate slidably coupled with the first post member and a handle coupled with the plate, wherein the handle and the plate are configured for concurrent displacement relative to the first post member;

a second post member configured for mating engagement with the first post member; and a second structure including a housing member and a magnet partially disposed within the housing member, the second structure coupled with the second post member, wherein the first structure and the second structure are located and cooperatively configured with a selective magnetic coupling mechanism for selective magnetic coupling of the first structure and the second structure with one another when the first post member and the second post member are engaged, the selective magnetic coupling mechanism movable between a first position to provide an attractive magnetic flux between the first structure and the second structure and a second position to provide no significant magnetic flux between the first structure and the second structure; and wherein an opening is formed in the second post member, wherein the magnet is sized, located and configured to at least partially extend through the opening formed in the second post member.

2. The partition system of claim 1, wherein the at least one door includes a first door having at least one foldable partition coupled with the first post member and a second door having at least one foldable partition coupled with the second post member.

3. The partition system of claim 1, wherein the magnet includes a neodymium magnet.

4. The partition system of claim 1, wherein the opening formed in the second post member is sized and configured to prevent the housing member from passing therethrough.

5. The partition system of claim 4, wherein the second structure is sized and configured to float relative to the second post member within a predefined spatial range.

6. The partition system of claim 5, further comprising a bracket coupled with the second post member, wherein the housing member is pivotally coupled to the bracket.

7. The partition system of claim 6, wherein the housing member includes a slot formed in a first end thereof, wherein the magnet is disposed within the housing member adjacent the slot, and wherein a fastener extends through a portion of the housing member and is located and configured to provide a clamping force between the housing member and the magnet.

8. The partition system of claim 1, further comprising a cam associated with the first post member, the cam being displaceable between a first position and a second position, wherein the cam is substantially within an interior cavity of the first post member when in the first position and wherein a portion of the cam extends through an opening formed in the first post member when the cam is in the second position.

9. The partition system of claim 8, wherein an opening is formed in the second post member and wherein, when the first post member and the second post member are engaged, and when the cam is in the second position, a portion of the cam extends through the opening formed in the second post.

10. The partition system of claim 9, further comprising an actuator coupled with the cam and configured to selectively displace the cam between the first position and the second position.

11. A method of operating a partition system having at least one foldable partition coupled with a first post member, and a second post member configured for mating engagement with the first post member, the method comprising:

displacing a first post member of a first foldable partition and engaging a second post member with the first post member;

sliding a first structure formed of a ferrous material and associated with the first post member relative to the first post member with a handle to align the first structure with a second structure associated with the second post member including a housing member and a magnet partially disposed within the housing member, and the second post member having an opening formed therein, wherein the magnet is sized, located and configured to at least partially extend through the opening formed in the second post member; and magnetically coupling the first structure with the second structure after engaging the second post member with the first post member.

12. The method according to claim 11, further comprising selectively displacing the first structure relative to the first post member to at least weaken a magnetic attraction between the first structure and the second structure while the second post member is engaged with the first post member.

13. The method according to claim 12, further comprising displacing the first post member away from the second post member after selectively displacing the first structure relative to the first post member to at least weaken the magnetic attraction between the first structure and the second structure.

14. The method according to claim 13, wherein engaging the second post member with the first post member further includes displacing the second post member.

15. The method according to claim 11, further comprising configuring the magnet as a neodymium magnet.

16. The method according to claim 11, further comprising disposing a cam within an interior portion of the first post member in a first position, and selectively displacing the cam to a second position such that at least a portion of the cam extends through an opening formed in the first post member and through an opening formed in the second post member.

17. The method according to claim 16, further comprising:

selectively displacing the first structure relative to the first post member to at least weaken a magnetic attraction between the first structure and the second structure;

selectively displacing from the first position to the second position; and displacing the first post member away from the second post member.

18. A partition system comprising:

at least one door having at least one foldable partition coupled with a first post member;

a first structure coupled with the first post member;

a second post member configured for mating engagement with the first post member; and a second structure coupled with the second post member, wherein the first structure and the second structure are located and configured for selective magnetic coupling with one another when the first post member and the second post member are engaged; and wherein the first structure is formed of a ferrous material and wherein the second structure includes a magnet; and wherein the first structure includes a plate slidably coupled with the first post member; and further comprising:

a handle coupled with the plate, wherein the handle and the plate are configured for concurrent displacement relative to the first post member; and wherein the second structure includes a housing member and wherein the magnet is partially disposed within the housing member; and wherein an opening is formed in the second post member, wherein the magnet is sized, located and configured to at least partially extend through the opening formed in the second post member.

* * * * *